United States Patent [19]

Maruska

[11] 4,013,811

[45] Mar. 22, 1977

[54] LAMINATED ANODE

[75] Inventor: Gerald F. Maruska, Madison, Wis.

[73] Assignee: Oscar Mayer & Co. Inc., Madison, Wis.

[22] Filed: Mar. 11, 1975

[21] Appl. No.: 557,293

[52] U.S. Cl. ..... 428/35; 428/458; 220/63 R; 220/64; 204/197; 204/148

[51] Int. Cl.[2] ..... B65D 5/56

[58] Field of Search ..... 428/35, 458; 204/197, 204/148; 220/64, 63 R; 426/322,323

[56] References Cited

UNITED STATES PATENTS

| | | | |
|---|---|---|---|
| 1,958,765 | 10/1932 | Perkins | 204/197 |
| 2,299,090 | 12/1938 | Hothersall | 204/197 |
| 3,152,717 | 10/1964 | Schwaiger | 220/64 |
| 3,202,596 | 11/1961 | Canevari | 204/197 |
| 3,888,224 | 6/1975 | Okuhara et al. | 220/64 X |

*Primary Examiner*—Ralph S. Kendall
*Assistant Examiner*—Charles R. Wolfe, Jr.
*Attorney, Agent, or Firm*—Lockwood, Dewey, Zickert & Alex

[57] ABSTRACT

A laminated anode including a layer of sacrificial metal and a layer of impermeable material. The laminated anode is utilized to protect a metal mold from corrosion where the mold is used for processing a corrosive meat material.

8 Claims, 7 Drawing Figures

FIG. 1
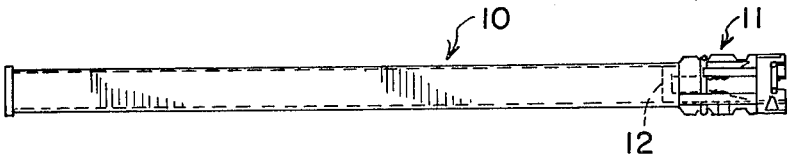
FIG. 2
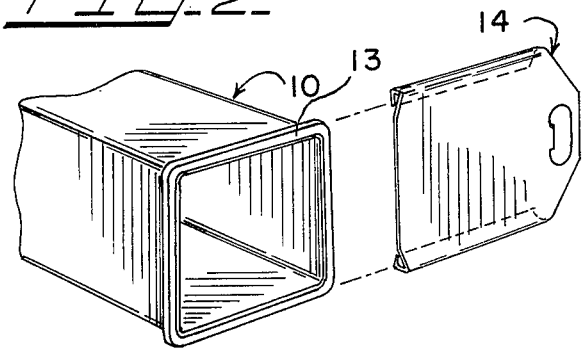
FIG. 3
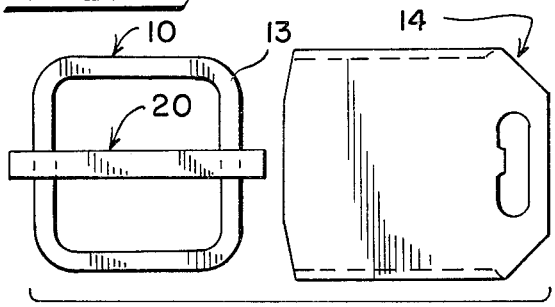
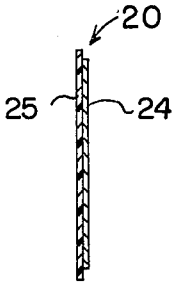
FIG. 7
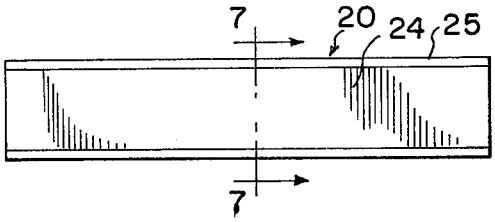
FIG. 6
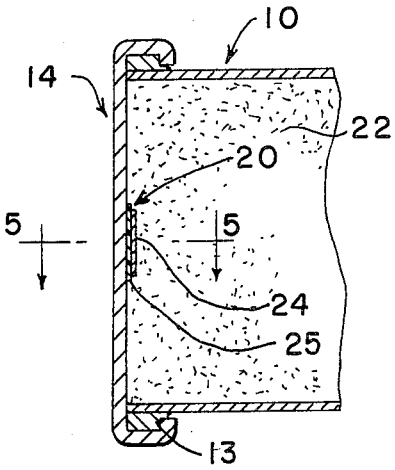
FIG. 4
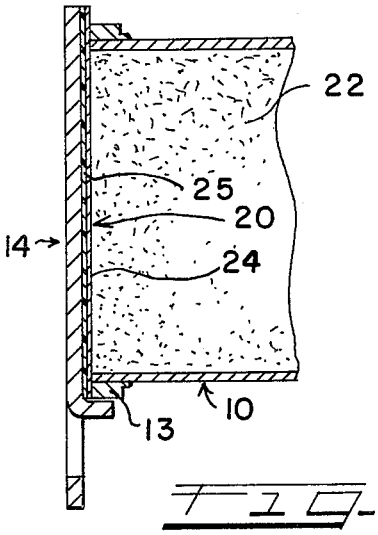
FIG. 5

LAMINATED ANODE

This invention relates in general to the protection of a metal mold used in the processing of a food product, and more particularly to a laminated anode used with a metal mold during the processing of a corrosive meat material to protect the metal mold from corrosion.

Heretofore, it has been known to provide a sacrificial anode in a metal container for packaging meat to prevent the salts of the meat from attacking either the metal container or a coating on the metal container. More specifically, it has been known to provide a consumable material (such as aluminum) in metal cans containing ham. However, it has not been known to provide cathodic protection to a metal mold in which meat is processed, such as by cooking and chilling, to prevent corrosion of the mold.

The present invention overcomes the heretofore known problems by providing an anode strip for use in the processing of a meat material in a metal mold. The anode strip is laminated, wherein a layer of consumable or sacrificial metal is provided with a layer of impermeable material to protect any surface against which the anode engages on the side of the impermeable material.

In a preferred embodiment of this invention, the laminated anode is useful in a loaf processing system where an elongated tubular metal mode is filled with a stuffable meat material, such as a sausage batter or chunk meat, and closed with a removable cover, also of metal. The laminated anode is placed between the end of the mold and the cover so that the sacrificial metal is in contact with the metal material and the metal mold, while the impermeable layer of the anode is in contact with the cover. The consumable metal on the laminated anode is less noble than the metal of the mold and cover, whereby the salts in the meat tend to attack the consumable metal and not the mold or cover. Further, the impermeable layer of the anode substantially prevents any corrosion deposits on the cover during the sacrificing of the metal layer of the anode.

It is therefore an object of the present invention to provide cathodic protection to a metal mold filled with a meat material, thereby protecting the metal mold.

It is a further object of the present invention to provide a laminated anode for use with a metal mold and removable cover assembly, wherein the anode includes a sacrificial metal less noble than the mold and cover material and an impermeable material for isolating the sacrificial metal from the cover.

Other objects, features and advantages of the invention will be apparent from the following detailed disclosure, taken in conjunction with the accompanying sheets of drawings, wherein like reference numerals refer to like parts, in which:

FIG. 1 is an elevational view of a mold of the type with which the present invention may be utilized;

FIG. 2 is a fragmentary perspective view of the end of the mold and a removable cover for association with the end;

FIG. 3 is an end elevational view of the end of the mold in FIGS. 1 and 2 and showing the laminated anode in position over the end of the mold with the cover arranged nearby and ready to be slipped into place;

FIG. 4 is a longitudinal sectional view taken through the mold and cover assembly and the laminated anode;

FIG. 5 is a sectional view taken substantially along line 5—5 of FIG. 4;

FIG. 6 is a plan view of a laminated anode showing the relationship between the metal layer and the impermeable layer; and FIG. 7 is a transverse sectional view taken through the strip of FIG. 6 and substantially along the lines 7—7 of FIG. 6.

Referring now to the drawings and particularly to FIG. 1, an elongated tubular mold 10 is illustrated which, as seen in FIG. 2, is substantially square in cross section. The tubular mold 10 is provided with a plug take-up mechanism 11 at one end which includes a plastic plug 12 positionable and movable within the mold and also acting as an end wall for closing one end of the mold. The other end of the mold is provided with a peripheral flange 13 to facilitate removably securing thereon a removable slip-on cover 14. It will be appreciated that a suitable stuffable meat material is loaded into the mold from the flanged end, after which the slip-on cover 14 may be applied for closing the mold so that the mold may be transported through processing stations, such as cooking and chilling stations, prior to removal of the cover and knockout of the loaf meat product.

The particular mold and cover shown in FIG. 2 are made of a suitable metal, such as stainless steel. However, it should be appreciated that the mold and cover structure form no part of the present invention and that the laminated anode of the present invention can be used with any type of mold which may or may not have a cover arrangement. If a cover is not present, the layer of impermeable material is positioned between the metal mold and the layer is sacrificial metal in the area where the meat material is in contact with the layer of sacrificial metal.

The laminated anode of the present invention is generally indicated by the numeral 20. The anode is in strip form and may be suitably cut to size for use with the mold and cover. Accordingly, the laminated anode may be provided in roll form from which a suitable length may be severed for use when applying it in position for use with a mold and cover arrangement. As seen in FIGS. 3, 4 and 5, the laminated anode 20 is of such a length as to extend wholly or partially across the open end of the mold and across the flange 13, wherein the cover 14 may be applied to close the open end and to hold the anode in place against the meat material 22 and the flange 13.

The laminated anode is constructed of a layer of consumable or sacrificial metal 24 and a layer of impermeable material 25. These layers may be secured together by use of an adhesive or other suitable means. The laminated anode is applied to the open end of the mold by placing the sacrificial metal 24 in contact with the meat material 22 and also in contact with the opposed flanged portions of the flange 13, as seen in FIGS. 3 and 5. Accordingly, electrical contact is made between the sacrificial metal 24 and the meat and between the sacrificial metal 24 and the mold. The impermeable material 25 laying against the underside of the cover 14 substantially prevents any staining of the cover as caused by sacrificing of the consumable metal 24. Accordingly, the surface of the cover is maintained in a clean and proper condition, and staining of the cover is substantially prevented.

The sacrificial layer 24 may be of any suitable metal which is less noble than the metal of the mold 10 and the cover 14. For example, when the mold and cover is of stainless steel, the sacrificial layer may be of aluminum, magnesium, zinc or any other suitable anodic material. The impermeable layer 25 may be of any suitable plastic that is approved for use with food, such as a polyethylene, polyester, polypropylene, acrylic, or polystyrene. For example, a polyester sold under the trade name Mylar is very satisfactory. The impermeable layer 25 may also be any suitable metal, such as tin or stainless steel.

The thickness of the sacrificial metal layer 24 may be whatever will provide a sufficient sacrificial life in connection with the particular meat material encountered. For example, the thickness may be, where it is aluminum, on the order of 0.003 to 0.005 inches. The exposed area of the sacrificial metal should be at least 2 square inches. The thickness of the impermeable layer may be of whatever is needed to provide adequate strength and may be, where it is plastic, on the order of 0.0005 to 0.001 inches.

It will be appreciated the laminated anode 20 is disposable after it has been used and, therefore, after the meat material has been suitably processed, the strip of laminated anode can be discarded upon removal of the cover 14.

From the foregoing, it will be appreciated that the laminated anode of the present invention provides cathodic protection to a metal mold and cover assembly and also protects the cover when used in conjunction with a mold and cover against the products of corrosion due to the reaction of the salts in the meat with the sacrificial layer of the anode.

It will be understood that modifications and variations may be effected without departing from the scope of the novel concepts of the present invention, but it is understood that this application is to be limited only by the scope of the appended claims.

The invention is hereby claimed as follows:

1. In the processing of a meat material in a metal mold of stainless steel, laminated means for substantially preventing the attack of the metal mold by the salts in the meat material, said means comprising (a) a layer of sacrificial metal less noble than the mold metal, said metal layer to be positioned at the end of the mold and held in generally full surface contact with the meat material and in electrical contact with the mold metal and (b) a layer of impermeable material between the metal mold and the layer of sacrificial metal in the area where the meat material is in contact with the layer of sacrificial metal for preventing contact of the sacrificial metal and mold in said area, said impermeable material having a character such as to prevent staining of the mold during sacrificing of the metal layer.

2. In the processing of a meat material in a metal mold having a removable cover, said mold and cover being of stainless steel, laminated means for substantially preventing the attack of the metal mold by the salts in the meat material, said means comprising (a) a layer of sacrificial metal less noble than the mold metal, said metal layer positioned between the end of the mold and the cover and held in contact with the meat material and the mold metal but not attached thereto and (b) a layer of impermeable material between the cover and the layer of sacrificial metal for isolating the sacrificial metal from the cover and for preventing staining of the cover during sacrificing of the metal layer.

3. A laminated anode for use in a metal mold of stainless steel during processing of a meat material in the mold to protect the mold surfaces in contact with the meat material against corrosive action, said anode being adapted to be placed and held between the mold and a cover therefor and being in strip form and flexible and including a layer of sacrificial metal less noble than the metal of the mold selected from the group consisting of aluminum, magnesium or zinc and a layer of impermeable material approved for use with food, wherein said sacrificial metal is in electrical contact with the mold and the meat material and said impermeable material being such as to protect the cover from sacrificial metal deposits and said strip being disposable after the processing of the meat material.

4. A laminated anode as defined in claim 3, wherein the sacrificial metal is aluminum.

5. A laminated anode as defined in claim 3, wherein the impermeable material is a plastic.

6. In combination with a tubular metal loaf mold for processing a stuffable meat material to produce a loaf meat product, wherein the mold includes a removable metal cover on one end, said mold and cover being of stainless steel, a laminated anode arranged between the cover and mold and against the meat material and mold metal, said anode comprising (a) a layer of sacrificial metal less noble than the mold and cover metal and in contact with the meat material and mold and (b) a layer of impermeable material in contact with the cover and isolating the sacrificial metal from the cover in the area of the meat material and preventing the staining of the cover during sacrificing of the layer of sacrificial metal.

7. Th combination defined in claim 6, wherein the sacrificial metal is aluminum.

8. The combination defined in claim 6, wherein the impermeable material is a plastic.

* * * * *